US005156234A

United States Patent [19]

McCallum et al.

[11] Patent Number: 5,156,234

[45] Date of Patent: Oct. 20, 1992

[54] LADDER STRUCTURE

[75] Inventors: Scott J. McCallum, Matakana; Bruce D. McCallum, Warkworth, both of New Zealand

[73] Assignee: McCallum Enterprises Limited, Warkworth, New Zealand

[21] Appl. No.: 761,470

[22] Filed: Sep. 18, 1991

[30] Foreign Application Priority Data

Sep. 18, 1990 [NZ] New Zealand ..... 235373

[51] Int. Cl.[5] ..... E06C 7/08; E06C 7/50

[52] U.S. Cl. ..... 182/46; 182/209; 182/215; 182/228

[58] Field of Search ..... 182/215, 228, 194, 217, 182/220, 46, 209

[56] References Cited

U.S. PATENT DOCUMENTS

| | | | |
|---|---|---|---|
| 848,114 | 3/1907 | Medart | 182/215 |
| 2,171,863 | 9/1939 | Pirsch | 182/215 |
| 2,598,278 | 5/1952 | Mason | 182/215 |
| 3,158,224 | 11/1964 | Van Name | 182/215 |
| 3,454,130 | 7/1969 | Pellandine | 182/46 |
| 3,674,110 | 7/1972 | Cooke | 182/46 |
| 4,371,055 | 2/1983 | Ashton | 182/46 |

FOREIGN PATENT DOCUMENTS

| | | | |
|---|---|---|---|
| 1177938 | 12/1958 | France | 182/215 |
| 619985 | 3/1949 | United Kingdom | 182/215 |

*Primary Examiner*—Reinaldo P. Machado

*Attorney, Agent, or Firm*—Jacobson, Price, Holman & Stern

[57] ABSTRACT

A single run or extension ladder particularly suitable for use where electrical safety is significant. Stiles 6 are each formed from a pair of elongate hollow members 5 fabricated from glass-fibre material. Rung supports 7 are formed from an aluminium extrusion comprising a pair of piped edge sections 8 separated by a pair of webs 9 in the nature of a box-section 10. The elongate members 5 extend through and are attached to the edge sections 8 by an adhesive. The rung supports 7 thus space the elongate members 5 adjacently apart to form a stile 6. The ends of rungs 12 are mounted in laterally aligning apertures 14 in the webs 9, the end of a rung 12 being crimped back onto an outer of the webs 9. End caps or feet 16 are provided on the stiles 6. An extension ladder is formed in conventional manner, to that end, saddles 18 telescopically captivate a pair of such single run ladders together.

2 Claims, 1 Drawing Sheet

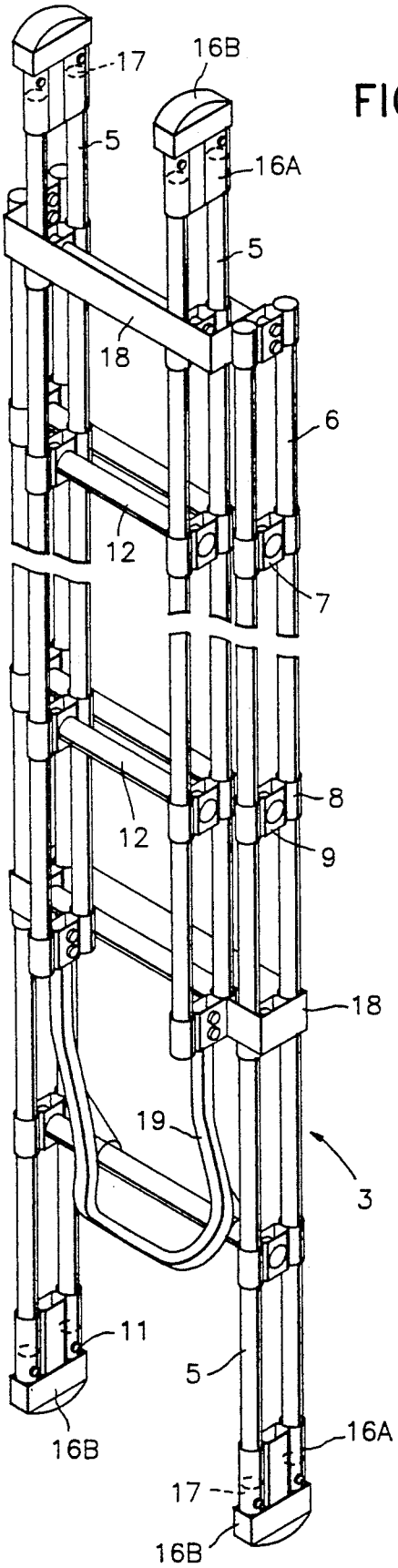
FIG. 1
FIG. 2
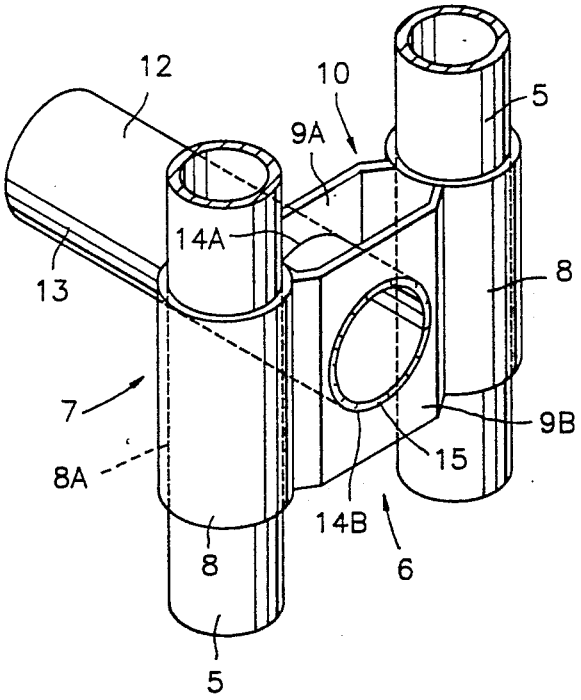

LADDER STRUCTURE

THE FIELD OF THE INVENTION

This invention relates to ladders and similar climbing apparatus. More particularly the invention relates to a single run or telescopic extension ladder incorporating stiles made from substantially inert material in particular an electrically non-conductive material.

THE PRIOR ART

The requirements and advantages of such a ladder are well documented in the prior art. The most relevant prior art of which applicant is aware are U.S. Pat. Nos. 3,674,110 and 4,371,055. While these patents, as with other prior art, teach a construction utilising electrically inert stiles or rails the structure of the present ladder applicant envisages provides advantages over the prior art.

BRIEF SUMMARY AND OBJECTS OF THE INVENTION

An intention of this invention is to provide a ladder of simple and economical construction which is of a lightweight and fabricated, at least in part, from material of sound electrical insulator characteristics rendering the ladder suitable for use where electrical safety factors are significant. Again the requirements for such a ladder are well documented in the prior art material.

A further intention is to provide a ladder of a structure that provides that the integrity of the material of the stiles is substantially maintained in particular at the junction of the rungs with the stiles. It is envisaged that this will enhance the strength and working life of the ladder.

According to a first aspect of this invention there is provided a ladder incorporating a pair of stiles each stile comprising a pair of longitudinally extending elongate elements attached, at rung spacing intervals, to rung supports formed by a pair of open ended hollow elements integrally conjoined by an intermediate section, the elongate elements of a stile each passing through and being mounted to aligned hollow elements of a series of rung supports to be spaced apart by the rung supports in a parallel fore and aft relationship with one another and rungs extending between and being mounted at their end sections to the intermediate sections of corresponding rung supports of pairs of laterally aligned rung supports, the rung spacing intervals of the stiles being common to dispose the rung supports of the respective stiles in laterally aligning pairs.

According to a second aspect of this invention there is provided a ladder as described in the preceding paragraph wherein a rung support intermediate section comprises a pair of laterally spaced apart webs which form with inwardly disposed portions of the walls of the hollow elements to form a box section, an end section or a rung extending through aligned apertures in the webs and being attached to at least an outer of the two webs.

According to a third aspect of this invention there is provided a ladder as described in either of the two preceding paragraphs wherein hollow tubes of glass-fibre material are utilised to form the elongate members of each stile.

BRIEF DESCRIPTION OF THE DRAWINGS

In further describing the invention reference is made to accompanying drawings of a preferred embodiment wherein;

FIG. 1 is a fragmented perspective view of an extension ladder constructed in accordance with the invention, and FIG. 2 is a detailed view of the structure of the ladder in particular of a junction between a rung and a stile thereof.

DETAILED DESCRIPTION OF THE PREFERRED EMBODIMENT

An extension ladder 3 is constructed with each stile 6 formed by a pair of elongate members 5 joined by rung supports 7. Preferably the elongate members 5 are constructed from lengths of rigid or semi-rigid material being either solid rods or hollow tubes, preferably the latter. Preferably the tubes are fabricated from glass fibre material to thus be inert and in particular have sound electrical insulating characteristics. The elongate members are preferably formed by known pultrusion methods and have an outside diameter of approximately 25 mm with a wall thickness of about 1.5 to 2 mm. These dimensions as well as ensuring that during manufacture the orientation of a substantial percentage of the fibres are longitudinal ensures the tubes are of appropriate rigidity.

In constructing a stile 6 a pair of elongate members 5 are attached at regular intervals to the rung supports 7. A rung support 7 preferably comprises of pair of open ended hollow tube like elements 8 conjoined by an intermediate section 9. Preferably a rung support 7 is formed from an appropriate length, say 100 mm, of a parent length of an aluminium extrusion of required cross-section. Referring in particular to FIG. 2, a rung support 7 and thus the rung support extrusion comprises a pair of piped longitudinal edge sections which form the open ended hollow elements 8. These are conjoined by a pair of laterally spaced apart web sections 9 extending tangentially or near tangentially between the corresponding wall portions of the hollow elements 8 to form a box-section, indicated generally by arrow 10, therewith. The thickness of the walls of the extrusion is preferably about 2 mm. A bore 8*a* of the hollow elements 8 is of a diameter commensurate to the external diameter of the elongate elements 5 as to provide that the elongate elements are a close sliding fit therethrough. With such assembly of a stile 6 the rung supports 7 are spaced along the elongate members at a desired rung spacing interval and attached thereto preferably by an adhesive, for example a suitable epoxy resin, inserted into the bores 8*a*. Additionally and/or alternatively mechanical means such as pop rivets or self-tapping screws 11 (depicted with respect to end caps as described below) can be utilised to attach an elongate member 6 to a rung support 7. However utilising such devices does involve penetration of the material of the elongate elements 5 and it is preferred not to so impair the integrity of that material. The elongate members 5 of a stile 6 are thus spaced apart in a parallel fore and aft relationship with one another with the web sections 9 of the rung supports 7 extending therebetween. This lattice like structure provides a stile 6 of substantial "fore and aft" rigidity and overcomes the flexibility of an elongate tube element 5 on its own.

Rungs 12 are provided to extend between laterally associated rung supports 7 of a pair of stiles 6 disposed in an adjacently spaced parallel relationship typical of a single run parallel sided ladder. Preferably the rungs 12 are formed from appropriate lengths of a parent length of aluminium extrusion of a suitable foot supporting cross-section. For example, the rungs 12 are preferably of a hollow cylindrical shape with longitudinally extending grooves or ribs 13 formed on the outer surface to facilitate grip. The wall thickness of a rung 12 is preferably similar to that of a rung support 7. The end sections 12*a* of a rung 12 are mounted to the web sections 9 of the rung support 7. Referring in particular to FIG. 2 in a preferred embodiment laterally aligned apertures 14 are formed in the two webs 9 of a rung support 7 and an end section of a rung 12 extended through an inner of the apertures 14*a* to terminate marginally through an outer of the apertures 14*b*. Attachment of a rung 12 to a rung support 7 is preferably at least to the outer web 9*b* such as by crimping 15 as depicted, the end of a rung 12 back on itself to engage the outer web 9*b*.

Referring in particular to FIG. 1 preferably end caps 16 or feet are provided on each stile 6. Preferably an end cap 16 is mounted by attaching an appropriate length of the rung support extrusion 7 to the ends of the elongate members 5 in substantially identical manner to mounting a rung support 7. The end cap support extrusion 16*a* is so mounted to project clear of the ends of the elongate members 5. An end cap 16*b* formed, for example, from solid rubber or similar material, to have a pair of projections 17 is disposed to locate within the extending open ends of the end cap extrusion 16*b*. Preferably the caps 16*b* are attached by pop rivets 11 or self-tapping screws extending through the wall of an end cap extrusion 16*a* to engage the projections 17 of an end cap pad 16*b*.

Described so far is a single rung ladder such as forming one of the runs of the telescopic ladder depicted in FIG. 1. Such telescopic ladder is formed in substantially conventional manner such as by providing two single run ladders one of which is of a marginally narrower width than the other as will fit between the stiles 6 thereof. More particularly a pair of saddles 18 are provided one to each of opposing ends of each run to extend about and slidingly captivate the opposing run to thus telescopically conjoin the two runs together. A detent 19 is pivotally mounted, to what in use is a lower end, of the inner run as to be engageable against the rungs 12 of the wider run to set the ladder at a particular extension. A line and pulley means (not depicted) can be provided to facilitate extension and retraction of the runs of the ladder.

We claim:

1. A ladder incorporating a pair of stiles each stile comprising a pair of longitudinally extending elongate hollow glass-fibre elements attached to rung supports each formed from a length of aluminum extrusion and comprising a pair of longitudinal piped edge sections conjoined by a pair of laterally spaced apart webs forming a box-section; the elongate elements of a stile each passing through and being adhesively attached within said piped edge sections to a series of said rung supports disposed along the elongate members at rung spacing intervals and with the rung supports spacing the elongate members of a stile apart in a parallel fore and aft relationship with one another; rungs extending between and being mounted to pairs of laterally aligned rung supports; end sections of a rung locating in laterally aligned apertures provided in inner and outer webs, of the box-section of an associated rung support, the ends of a rung being crimped back on themselves to engage with the outer webs, and wherein end caps are provided on the ends of the stiles, each end cap comprising a length of rung support extrusion mounted to the stile in similar manner to a rung support but so as to extend beyond the associated ends of the elongate members whereby the extending ends of the piped edge sections form end opening voids, a pad being mounted thereto said pad incorporating projections disposed to be located in and fixed within said voids.

2. An extension ladder consisting of a pair of single run ladders as claimed in claim 1 with one being narrower than the other as to fit between the stiles thereof, a pair of saddles being provided one to each of opposing ends of each run to extend about and slidingly captivate the opposing run to telescopically conjoin the runs, a pivotally mounted detent being provided at, what in use is a lower end, of the inner run to be engageable against the rungs of the wider run.

* * * * *